United States Patent [19]

Bindl et al.

[11] Patent Number: 4,510,891

[45] Date of Patent: Apr. 16, 1985

[54] LIQUID BOILER, PARTICULARLY UTILITY-WATER BOILER

[76] Inventors: Max Bindl, Wernberger Strasse 41, D-8473 Pfreimd; Heinz Reusch, Lerchenstrasse 4a, D-8450 Amberg, both of Fed. Rep. of Germany

[21] Appl. No.: 567,962

[22] Filed: Jan. 4, 1984

[51] Int. Cl.[3] ..... F22B 1/02

[52] U.S. Cl. ..... 122/32; 122/13 R; 126/361; 126/427; 126/437; 165/163

[58] Field of Search ..... 122/13 R, 14, 16, 18, 122/19, 27, 31 R, 32; 126/350 R, 361, 427, 437; 165/156, 163

[56] References Cited

U.S. PATENT DOCUMENTS

| | | | |
|---|---|---|---|
| 4,182,409 | 1/1980 | Robinson, Jr. | 126/437 |
| 4,222,350 | 9/1980 | Pompeii et al. | 122/32 |
| 4,253,446 | 3/1981 | Muller | 126/437 |
| 4,357,932 | 11/1982 | Stacy | 126/437 |
| 4,361,276 | 11/1982 | Paige | 122/19 |

FOREIGN PATENT DOCUMENTS

| | | | |
|---|---|---|---|
| 2034457 | 6/1980 | United Kingdom | 126/437 |

*Primary Examiner*—Edward G. Favors
*Assistant Examiner*—Steven E. Warner
*Attorney, Agent, or Firm*—Jacobs & Jacobs

[57] ABSTRACT

A water boiler which has a tank with a cylindrical circumferential wall, a cover and a convexly outwardly curved bottom, and at least one heat exchanger is in the tank, the heat exchanger being formed by at least one pipe coil of spiral or meandering development, the turns of which lie in a plane parallel to or in the direction of the axis of the tank, and the circumferential wall has at least one connection socket which is closed by a plate with the forward and return runs of the heat exchanger extending in sealed fashion through said plate.

5 Claims, 6 Drawing Figures

LIQUID BOILER, PARTICULARLY UTILITY-WATER BOILER

The present invention relates to a liquid boiler, particularly a utility-water boiler, consisting of a tank whose inner space is closed by a cylindrical circumferential wall, by a cover and by a convexly outwardly curved bottom and which has connections extending into the inner space for the feeding and removal of the liquid, and of at least one heat exchanger forming at least one closed conduit for the heat-carrier fluid, which heat exchanger is arranged in said inner space of the tank and is formed by at least one pipe coil of spiral or meandering development the turns of which lie in a common plane.

Liquid boilers (utility-water boilers) are known in numerous embodiments and are used in particular for the obtaining of hot water in solar energy plants, in systems having heat pumps and in ordinary heating systems. One basic problem with such boilers is that the best possible efficiency, i.e., the best possible heat transfer between the heat exchanger and the liquid (for instance water) present within the tank is desired. Another problem is that such boilers are to be as compact as possible, which presupposes, inter alia, that the partial region of the inner space of the container which remains within the boiler below said at least one heat exchanger must be of the smallest possible volume since this partial region acts as dead space or, upon normal convection of the liquid present in the boiler (heated liquid rises and colder liquid sinks) is not reached by the flow of liquid related thereto. Said dead space results, in particular, from the fact that liquid boilers must have an outwardly convexly curved bottom in order to obtain the required resistance to pressure, so that it is not readily possible to arrange said at least one heat exchanger in such a manner that it extends to as close as possible to the bottom.

The object of the present invention is to provide a liquid boiler which is of particularly high efficiency and with which it is also possible to keep said dead space as small as possible.

In order to achieve this object, a liquid boiler of the type mentioned above is so developed, in accordance with the invention, that the plane of the turns of the at least one pipe coil of the at least one heat exchanger is arranged parallel to or in the direction of the axis of the cylindrical circumferential wall.

By this arrangement, the result is first of all obtained that the plane of the at least one heat exchanger which is formed by the turns of the at least one pipe coil lies in the direction of the axis of the cylindrical circumferential wall so that when the liquid boiler is operated upright (the axis of the cylindrical circumferential wall lies in vertical direction) the flow of liquid which takes place in the inner space of the container extends over a large region along the heat exchanger, this flow being scarcely impeded, furthermore, by the heat exchanger or its turns. Furthermore, due to the special arrangement of the heat exchanger it is possible for at least a partial region thereof to extend to the immediate vicinity of the inner surface of the curved bottom, resulting in an extremely small amount of dead space, or a very compact development of the liquid boiler being possible as a result of the small amount of dead space.

As a further development of the invention, in a liquid boiler which is provided on its cylindrical circumferential wall with openings for the passage of the forward and feed runs of said at least one heat exchanger as well as with openings for connecting pipes, all openings are so arranged that, regardless of the diameter of the tank and thus regardless of the size of the liquid boiler, they are at all times at constant distance from each other, i.e., a flat blank of steel plate used for the manufacture of the cylindrical circumferential wall always shows the same drilling pattern with respect to these openings regardless of the size of the liquid boiler. In this way, not only is the manufacture of the liquid boiler considerably simplified but, in particular, it also is possible to use one and the same shell element in insulating material for the shell of heat-insulating material necessary for liquid boilers, regardless of the size of the tank, in order to cover the region provided with these openings, the element being of relative complicated development in view of the required holes or openings (for the forward or return runs of said at least one heat exchanger and for the connecting pipes of their sockets). The rest of the tank or its circumferential wall is covered by a shell element which has no such holes or openings and consists of a web of heat-insulating material the blank for which can be easily adapted to the size of the specific tank.

Further developments of the invention are set forth in the subordinate claims.

The invention will be explained in further detail below with reference to an illustrative embodiment shown in the drawing, in which.

Figure 1:
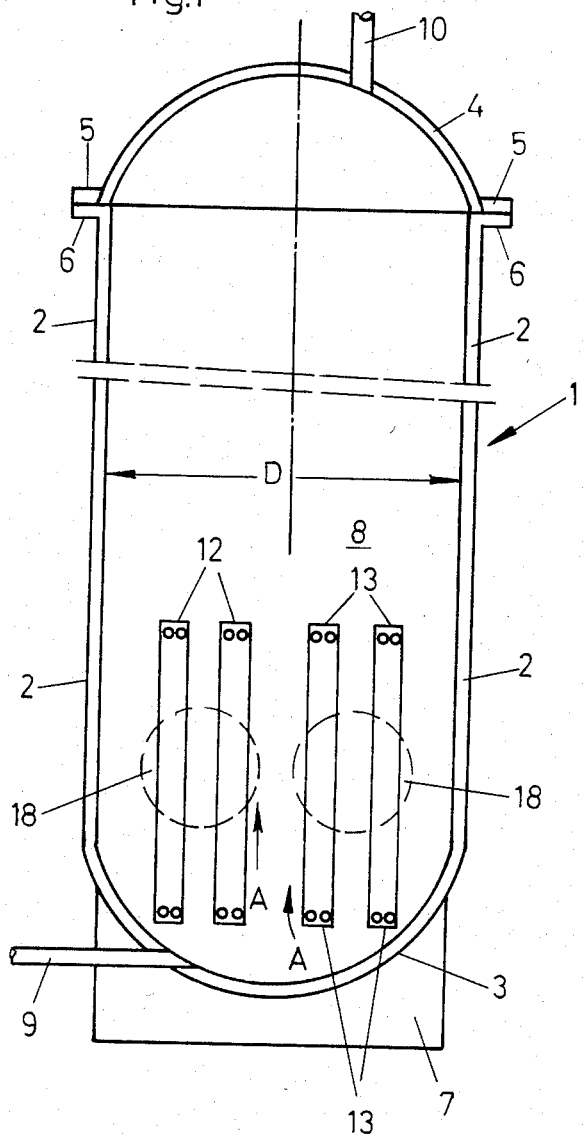
FIG. 1 is a diagrammatic longitudinal section through a utility-water boiler according to the invention.
Figure 2:
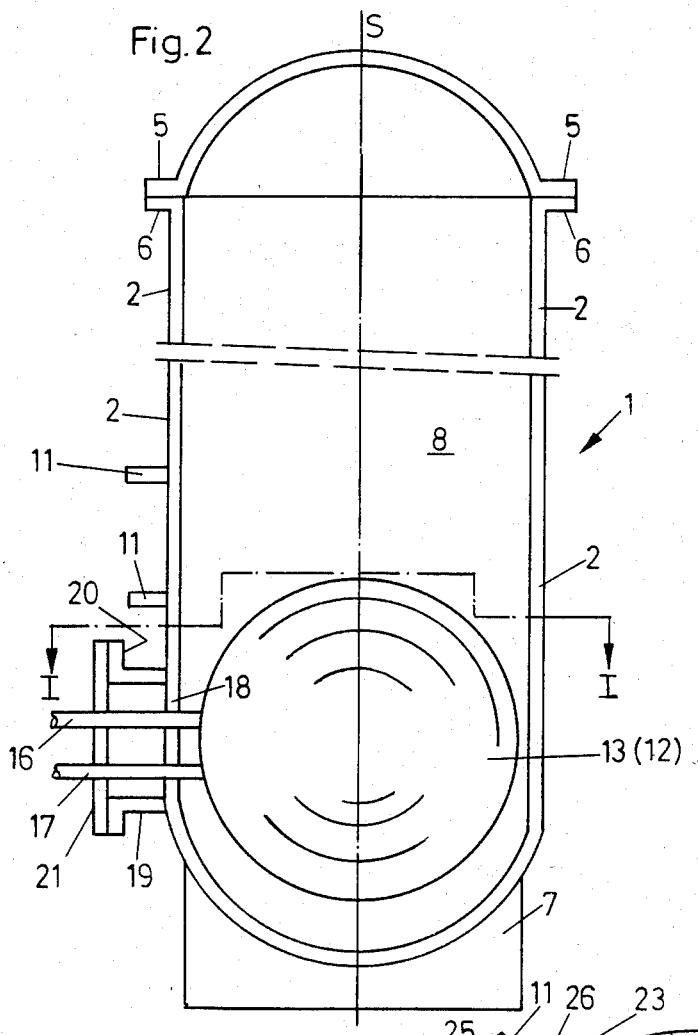
FIG. 2 is a showing similar to FIG. 1 but with the utility-water boiler turned 90° around its tank or cylinder axis S as compared with FIG. 1.
Figure 3:
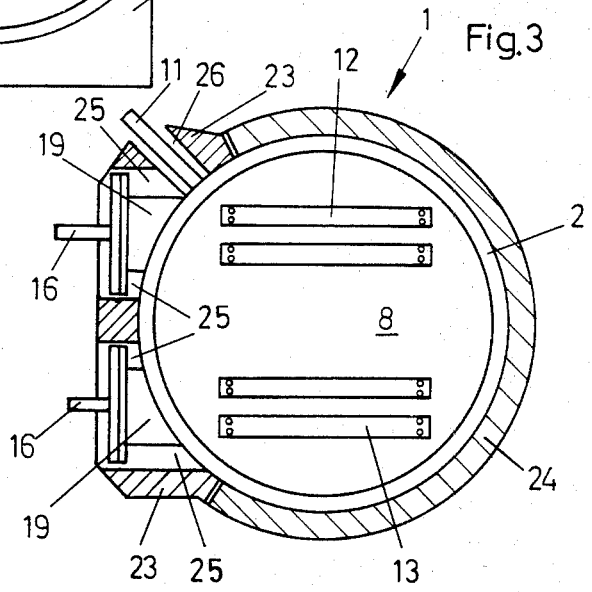
FIG. 3 is a section along the line I—I of FIG. 2.
Figure 4:
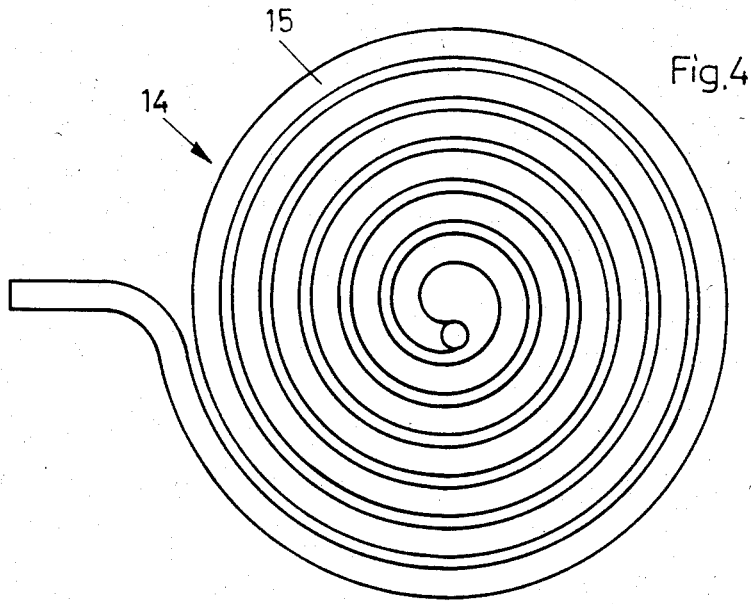
FIGS. 4 and 5 show two different embodiments of a pipe coil bent in spiral or meandering shape, used as heat exchanger.

The utility-water boiler shown in the figures consists essentially of a tank 1 which has a closed circumferential wall 2, shaped as a circular cylinder, a bottom 3 which is also closed and curved convexly outward, and a cover 4. The circumferential wall 2, the bottom 3 and the cover 4 are all made of steel plate. The cover 4 is provided at its edge with an outwardly protruding annular flange 5 by which the cover 4 is held sealed but detachable (by bolts not shown in detail) against a mating flange 6 on the upper edge of the circumferential wall 2. The bottom 3 is welded tight to the lower edge of the circumferential wall 2. On the bottom 3 there is furthermore fastened a supporting frame 7 by means of which the tank 1 can be stood upright on a base surface, i.e., with the axis of symmetry S of the circumferential wall 2 in vertical direction. In the bottom 3 there is provided a connection pipe for the feeding of cold water which debouches into the inner space 8 of the tank 1. A connection pipe 10, also debouching into the inner space 8, is provided on the cover 4. As alternative to or in addition to the connection pipes 9 and 10 there are also arranged on the circumferential wall 2 additional connection pipes 11 debouching into the inner space 8 or connection sockets for such pipes. In the inner space 8 of the embodiment shown, there are two heat exchangers 12 and 13 which, as shown in FIGS. 1 to 3, are formed in each case of spirally bent pipe coils 14, the individual turns 15 of each pipe coil 14 lying in a common plane or defining a plane for the pipe coil 14 in question. Each heat exchanger 12 and 13 is developed in two layers in the embodiment shown, i.e. it consists of two pipe coils 14 arranged parallel to and spaced from each other, the one outer end of the one pipe coil 14 of each heat exchanger forming the feed or forward run 16 and the one outer end of the other pipe coil 16 forming the return run 17 for the heat-carrier fluid and the two inner ends of the pipe coils 14 of each heat exchanger being directly connected with each other so that the two pipe coils 14 are connected in series. Of course, other types of connection of the pipe coils 14 of the heat exchangers 12 and 13 are also possible. The heat exchangers 12 and 13 are so arranged within the inner space 8 that their planes defined by the pipe coils 14 lie parallel to the axis of symmetry S. In this way it is possible so to arrange the heat exchangers 12 and 13, even in the case of a convexly outwardly curved bottom 3, that a part thereof extends as close as possible to the bottom 3 and therefore the lower part of the tank 1 is also covered by the heat exchangers 12 and 13 so that the region of the inner space 8 located below the heat exchangers 12 and 13 and not covered by them (dead space) is kept as small as possible. The heat exchangers 12 and 13, which are arranged at the same height in the inner space 8, are also parallel to each other in the embodiment shown, being on different sides of the axis of symmetry S (FIG. 1). Of course, it is also possible to arrange the heat exchangers 12 and 13 in such a manner that the planes defined by their pipe coils 14 form an angle with each other, preferably an acute angle.

For the connecting of the pipe-shaped forward and return runs 16 and 17 to an external system which feeds and removes the heat carrier fluid, the forward and return runs 16 and 17 are passed in sealed manner through the circumfential wall 2 of the tank 1. For this purpose, two small circular openings 18 are provided in the circumferential wall 2, their center points lying on a common circumferential line extending perpendicular to the axis of symmetry S of the circumferential wall 2 and by which the inner space 8 is in communication with, in each case, a pipe-shaped socket 19 which is fastened in sealed manner (for instance welded) to the circumferential wall 2 Each connection socket 19 whose axis is perpendicular to the axis of symmetry S is provided on its free end protruding outward beyond the circumferential wall 2 with an annular flange 20 and is closed there by means of a plate 21 having the shape of a circular disk which is fastened in removable manner to the flange 20. The forward and return runs 16 and 17 of the corresponding heat exchangers 12 and 13 respectively are passed in sealed manner through this plate 21.

Since the heat exchangers 12 and 13 formed by the pipe coils 14 have a diameter which is greater than the inside diameter of the connection sockets 19, the heat exchangers 12 and 13 are, when the tank 1 has been made ready but with the cover 4 still off, inserted from above into the inner space 8. Only after the installing of the heat exchangers 12 and 13 is the tank 1 closed by the cover 4. By removal of the cover 4, defective heat exchangers 12 and 13 can also be replaced by new ones.

In principle, it is also possible, instead of the heat exchangers 12 and 13 formed of the spirally bent pipe coils 14, to use heat exchangers whose pipe coils 14' are bent in meander shape, in such a manner that the individual turns 15' define an approximately rectangular surface the lengthwise direction L of which is perpendicular to the axis of symmetry S of the tank 1, the width B of this surface being somewhat smaller than the inside diameter of the connection sockets 19. Of course, the heat exchangers formed by the pipe coils 14' are also again arranged within the inner space 8 in such a way that their planes defined by the pipe coils 14' lie parallel to or in the direction of the axis of symmetry S.

Figure 5:
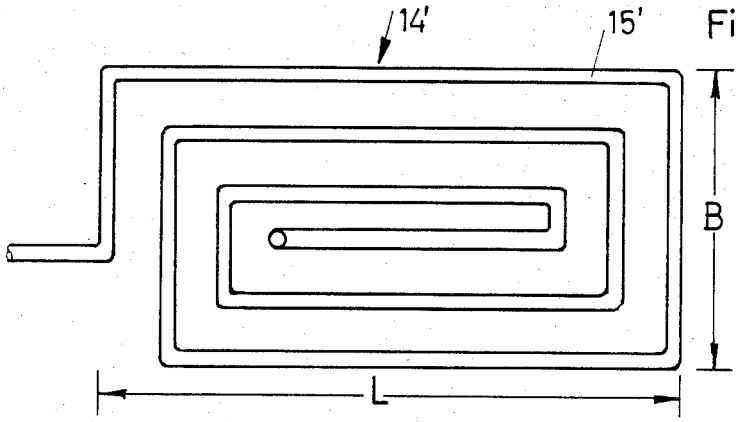

The use of heat exchangers which consist of the pipe coils 14' shown in FIG. 5 has the advantage that the heat exchangers can be introduced through the connection sockets 19 into the inner space 8 with the cover 4 closed. In order to replace defective heat exchangers it is also merely necessary to loosen the corresponding plate 21. Furthermore, the heat exchangers formed by the pipe coils 14' can also be arranged very low in the inner space 8.

Due to the fact that the planes of the heat exchangers defined by the pipe coils 14 and 14' lie parallel to or in the direction of the axis of symmetry S, the general advantage is obtained that, regardless of the specific development of the heat exchangers or of their pipe coils, the heat exchangers will be in contact with the heated water, which rises as shown by arrows A due to the natural convection and flows past the heat exchangers. Furthermore, the natural convection of the ascending water as it is heated is, for all practical purposes, not impeded by the heat exchangers, which contributes to a substantial improvement in efficiency.

Figure 6:
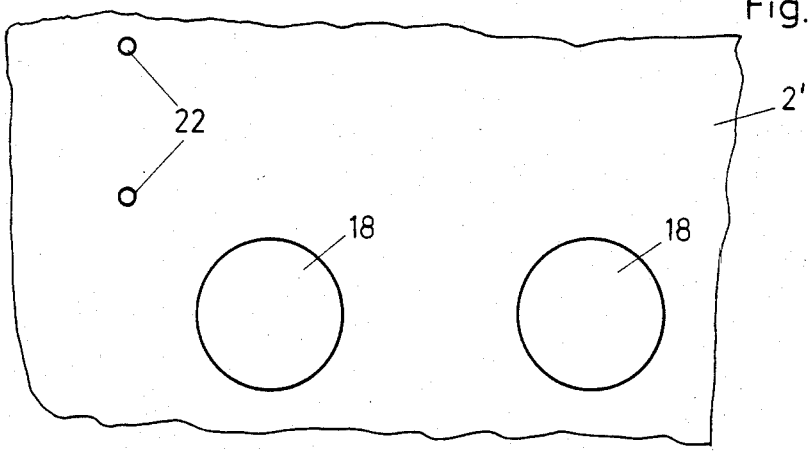
FIG. 6 shows, in partial top view, a flat blank of steel plate for the manufacture of the cylindrical circumferential wall of the utility-water boiler according to FIG. 1.

FIG. 6 shows a blank 2' of steel plate for the manufacture of the circumferential wall 2. The openings 18 as well as the additional openings 22 for the additional connection pipes 11 and for corresponding pipe sockets are provided in this blank. The special feature of the blank 2' resides in the fact that, regardless of the diameter D of the tank, the individual openings 18 and 22 in each case are at the same distance from each other. Furthermore, the blank 2' is developed in such a manner that the openings 22 are arranged on a common line lying perpendicular to the line connecting the openings 18. By this development of the blank it is possible to use, for tanks of all sizes, i.e., regardless of their diameter D, a covering of heat-insulating material which consists of a pre-formed element 23 which is common to all tank sizes and of an element 24 which then, to be sure, has a different size or arc length as a function of the size of the tank. The element 23 serves to cover the circumferential wall 2 in the region of the connection socket 19 and has corresponding holes 25 which receive said sockets, holes 26 being simultaneously provided in the element 23 for the additional connection pipes 11 or their connection sockets. The element 23 can thus, with this development of the blank 2', be used for tanks of all sizes so that manufacture and stocking are considerably simplified. The element 24 consists solely of a web of heat-insulating material without openings or holes and is adapted, by corresponding cutting, to the specific tank size. Of course, it is also possible to develop the elements 23 and 24 in such a manner that the additional connection pipes 11 and their connection sockets lie in the region of the line or separation between the elements 23 and 24, so that no holes 26 are necessary in the element 23 either. Regardless of the specific development of the element 23, the lines of separation between this element and the element 24 are in each case covered by an outer cover strip. The development of the blank 2′ which has been described and the advantages resulting therefrom are in themselves independent of the development or arrangement of the heat exchangers within the inner space 8 of the tank 1.

We claim:

1. A liquid boiler, particularly a utility-water boiler, comprising a tank whose inner space is closed by a cylindrical circumferential wall having a vertical axis, by a cover and by a convexly outwardly curved bottom and which has connections extending into the inner space for the feeding and removal of the liquid, and at least one heat exchanger forming at least one closed conduit for a heat-carrier fluid, said heat exchanger being arranged in said inner space of the tank and formed by at least one planar pipe coil of spiral or meandering, non-helical, development, the turns of which lie in a single plane said plane being parallel to or in the direction of the axis of said cylindrical circumferential wall, at least one connection socket being provided on said cylindrical circumferential wall, said socket being closed by a plate at the end thereof protruding from the outer surface of said cylindrical circumferential wall, and the forward and return runs of said at least one heat exchanger extending in sealed fashion through said plate.

2. A liquid boiler according to claim 1, characterized by the fact that two connection sockets with said plate are provided at the same height on the cylindrical circumferential wall.

3. A liquid boiler according to claim 1, characterized by the fact that the cover and/or the bottom are fastened in removable manner to the tank and/or its circumferential wall.

4. A liquid boiler according to claim 1, characterized by the fact that within the cylindrical circumferential wall of the tank connecting pipes or connection sockets for the connection of connecting pipes are provided, and that (regardless of the size or the diameter of the tank openings provided in the cylindrical circumferential wall for the connection pipes or their connection sockets are in each case at a predetermined distance from each other and from any existing openings for the connection sockets of the forward and return runs.

5. A liquid boiler according to claim 1, characterized by the fact that at least the circumferential wall of the tank is surrounded by a shell of heat-insulating material, which shell consists of two parts one of which can be used for all boiler diameters and has holes for the connection sockets of the forward and return runs of said at least one heat exchanger and possibly additional openings for the connection pipes or their sockets, while the other part of the shell is adapted in the shape of its blank or in its length of arc surrounding the cylindrical circumferential wall to the specific tank diameter.

* * * * *